US005082268A

United States Patent [19]

Santoro

[11] Patent Number: 5,082,268

[45] Date of Patent: Jan. 21, 1992

[54] CREDIT CARD DISPENSING AND POSITIONING APPARATUS

[75] Inventor: Robert L. Santoro, Copiague, N.Y.

[73] Assignee: J.A.D. Enterprises of New York, Inc., Farmingdale, N.Y.

[21] Appl. No.: 234,615

[22] Filed: Aug. 22, 1988

[51] Int. Cl.[5] ..... B65H 5/08

[52] U.S. Cl. ..... 271/14; 271/131; 271/138; 271/234; 271/253; 221/210; 221/220; 221/238; 221/241; 294/94; 294/95; 294/104; 414/797.8; 414/797.9

[58] Field of Search ..... 271/3, 4, 10, 131, 137, 271/138, 234, 253, 14; 221/210, 220, 238, 241; 414/795.7, 797.4, 797.8, 797.9; 294/97, 94, 95, 99.1, 103.1, 104

[56] References Cited

U.S. PATENT DOCUMENTS

| | | | |
|---|---|---|---|
| 701,358 | 6/1902 | Klepetar . | |
| 717,360 | 12/1902 | Dement . | |
| 1,958,248 | 5/1934 | Runk . | |
| 3,155,244 | 11/1964 | Rogers et al. | 414/797.8 X |
| 3,251,506 | 5/1966 | Brown et al. . | |
| 3,327,873 | 6/1967 | Malamood et al. | 414/797.8 X |
| 3,437,238 | 4/1969 | Luba . | |
| 3,445,035 | 5/1969 | Ackerman . | |
| 3,565,285 | 2/1971 | Asnes | 221/267 |
| 3,690,476 | 9/1972 | Stacy | 414/797.8 X |
| 3,700,139 | 10/1972 | Kelly | 221/241 |
| 4,238,125 | 12/1980 | Klietz | 271/131 X |
| 4,255,073 | 3/1981 | Schöttle | 414/797.9 X |
| 4,273,321 | 6/1981 | Luther et al. | 271/131 X |
| 4,344,729 | 8/1982 | Orsinger et al. | 294/104 X |
| 4,530,446 | 7/1985 | Dixon | 221/223 |
| 4,676,682 | 6/1987 | Schacht | 271/240 X |

FOREIGN PATENT DOCUMENTS

| | | | |
|---|---|---|---|
| 2121922 | 1/1972 | Fed. Rep. of Germany | 271/138 |

*Primary Examiner*—David H. Bollinger
*Attorney, Agent, or Firm*—Cobrin, Feingertz & Gittes

[57] ABSTRACT

Apparatus for accurately dispensing and positioning a credit card onto a predetermined area of a surface, includes a support tray which supports a stack of cards; a pusher assembly including a pusher plate which pushes out a leading edge of a lowermost one of the cards in the stack; gripper jaws which grip the lowermost edge of the pushed out card; and a control assembly which controls the gripper jaws to grip the lowermost edge of the pushed out card, to move over the predetermined area of the surface and to then release the gripped card so that the latter drops onto the predetermined area of the surface.

26 Claims, 7 Drawing Sheets 314
220b
326
322
318
316
320
324
220a
216
216a
250
220
222
242
232
224a
224
235
234
224b
212
233
228
226
250
210
224a
224
234
224b
244
228
235
226
233
JOHN DOE
214
222b
222a
312
218
214
282

294
296
332

348
346
336
350
364
344
362
328
352
338
354
360
272
368
378
370
374
280
214
282
372
382
384
386
382
384
386
310
366

CREDIT CARD DISPENSING AND POSITIONING APPARATUS

BACKGROUND OF THE INVENTION

This invention relates generally to credit cards, and more particularly, is directed to apparatus for dispensing credit cards from a stack and positioning such dispensed cards on an adhesive covered paper.

When preparing credit cards for mailing, the credit cards are often adhered to a piece of paper, generally by two small dabs of adhesive on the paper. Such paper generally contains some message associated with the credit card. With apparatus of this type, the credit card is dispensed from a stack of cards and the dispensed credit card is gripped by vacuum means. The card is then held by a gripper arm and positioned over the two dabs of adhesive, and released, whereby the credit card falls down onto the two dabs of adhesive so as to be secured on the piece of paper. However, such apparatus has not been altogether satisfactory. This is because the suction may not be satisfactory to maintain a firm grip on the credit cards.

Dispensing machines for dispensing flat cards or the like from a stack are well known. For example, U.S. Pat. No. 3,445,035 discloses apparatus for dispensing bingo cards from a stack, and onto a conveyor. See also U.S. Pat. No. 701,358 with respect to slot machines for vending pasteboard tickets and U.S. Pat. No. 3,437,238 with respect to the dispensing of butter pats.

Further, gripping mechanisms for handling different objects are also well known. For example, U.S. Pat. No. 4,530,466 discloses a gripping mechanism comprised of two opposing jaws for carrying cylindrical parts which are positioned in a row in a track. In U.S. Pat. No. 3,700,139, a spring loaded finger mechanism receives a slug from a rivet dispenser and inserts the slug into a previously drilled hold for the rivet. See also U.S. Pat. No. 1,958,248 with respect to a bottle cork feeding machine.

Other U.S. Patents of interest are U.S. Pat. Nos. 717,360 with respect to a machine for placing shields in cans, 3,251,506 with respect to a bag dispenser and 3,565,285 with respect to a button feeding machine.

OBJECTS AND SUMMARY OF THE INVENTION

Accordingly, it is an object of the present invention to provide apparatus for dispensing and accurately positioning a credit card onto a predetermined area of a surface.

It is another object of the present invention to provide apparatus for dispensing a credit card from a stack of credit cards, gripping the dispensed credit card with a gripper mechanism, moving the gripper mechanism over a predetermined area of a surface and releasing the credit card so that it is accurately positioned on such predetermined area.

It is still another object of the present invention to dispense and accurately position a credit card onto a predetermined area of a surface.

In accordance with an aspect of the present invention, apparatus for accurately positioning a card onto a predetermined area of a surface, includes support means for supporting a stack of cards; pusher means for pushing out a leading edge of a lowermost one of the cards in the stack; gripper means for gripping the lowermost edge of the pushed out card; and control means for controlling the gripper means to grip the lowermost edge of the pushed out card, to move over the predetermined area of the surface and to then release the gripped card so that the latter drops onto the predetermined area of the surface.

In accordance with another aspect of the present invention, a method for accurately positioning a card onto a predetermined area of a surface, includes the steps of supporting a stack of cards; pushing out a leading edge of a lowermost one of the cards in the stack; gripping the lowermost edge of the pushed out card with gripper means; moving the gripping means over the predetermined area of the surface; and releasing the gripped card so that the latter drops onto the predetermined area of the surface.

The above and other objects, features and advantages of the present invention will become readily apparent from the following detailed description which is to be read in connection with the accompanying drawings.

DETAILED DESCRIPTION OF THE PREFERRED EMBODIMENTS

Figure 1:
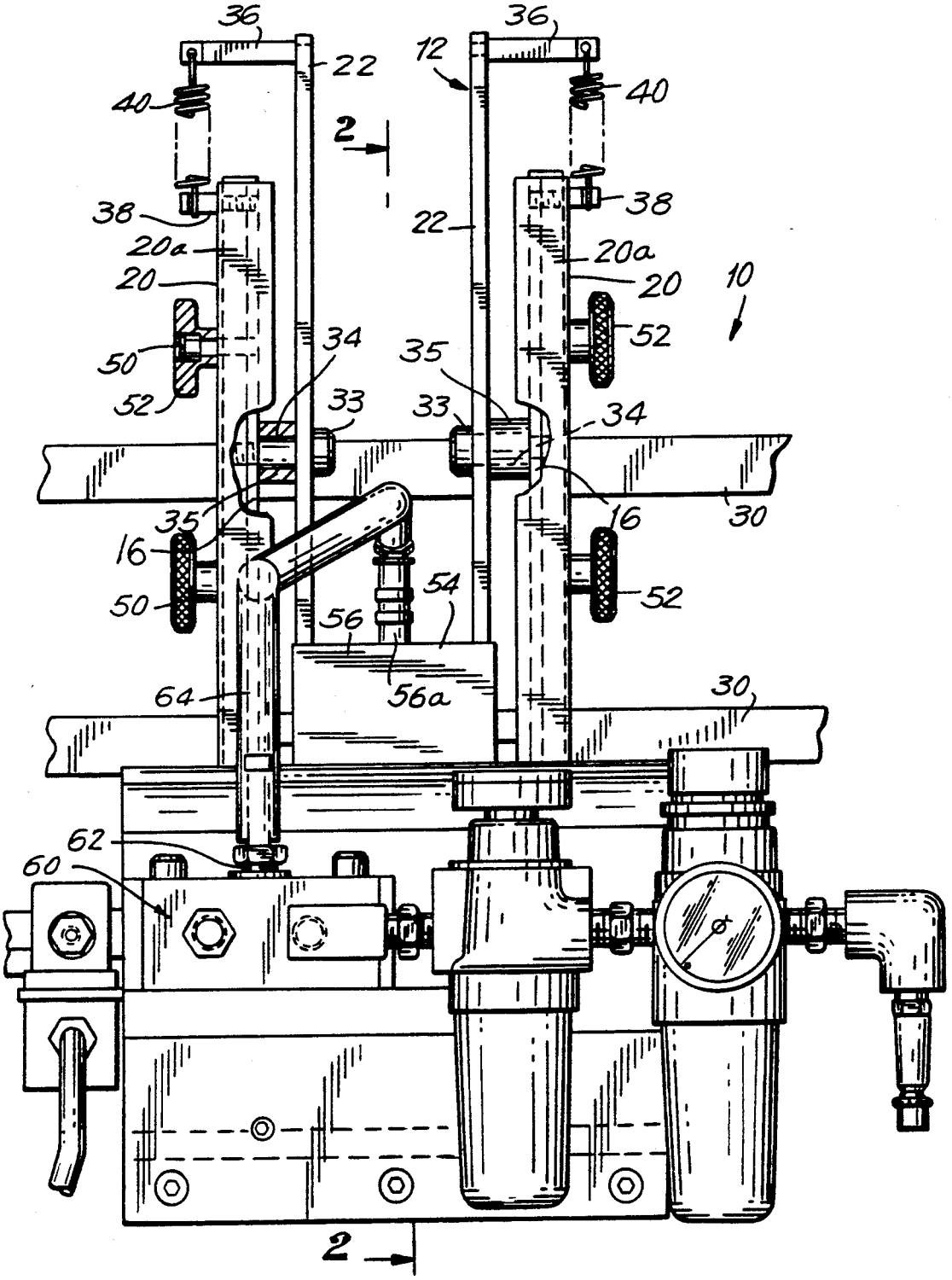
FIG. 1 is an end elevational view of apparatus for positioning a credit card according to one embodiment of the present invention.
Figure 3:
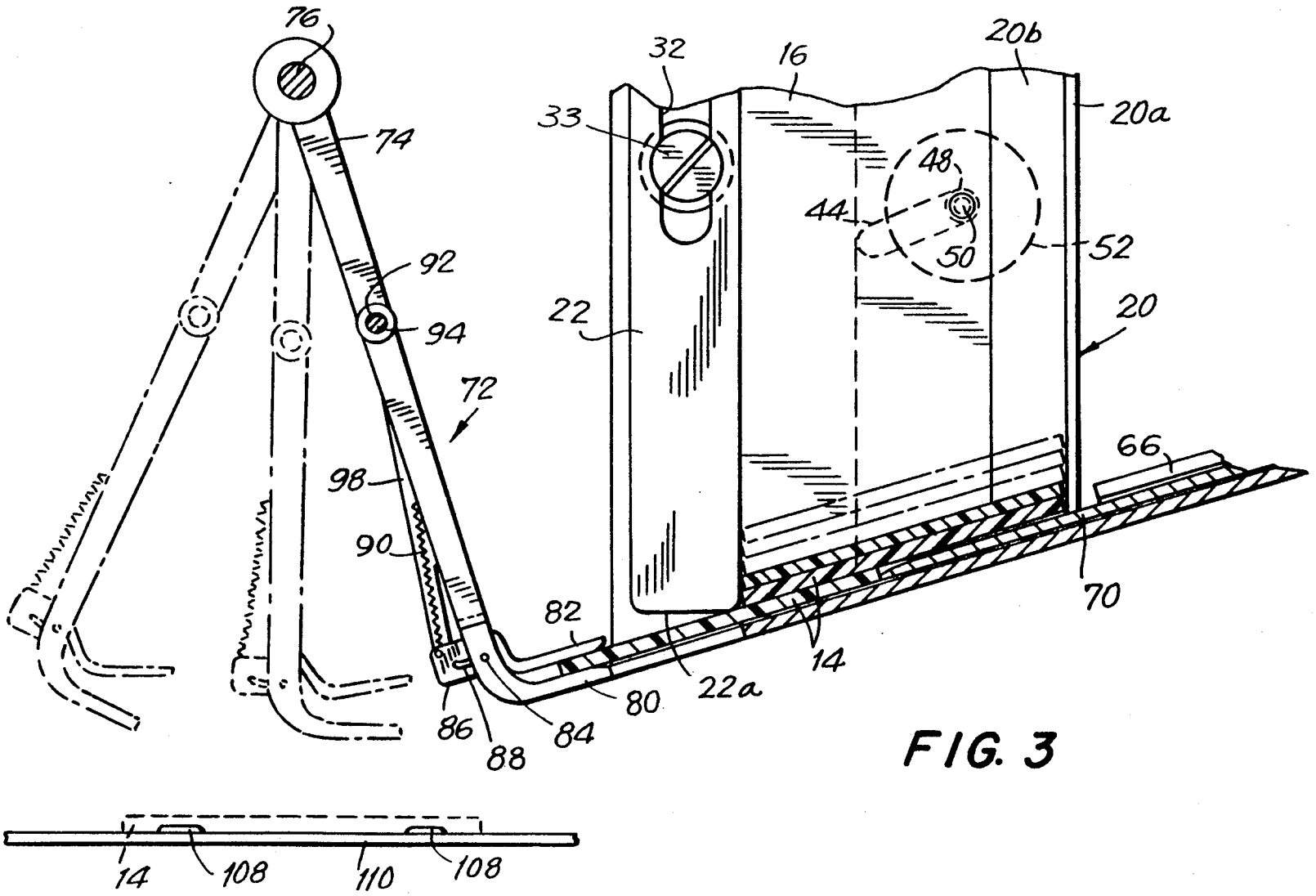
FIG. 3 is an enlarged cross-sectional view of a portion of the apparatus of FIG. 2 and the gripper mechanism thereof.

Referring to the drawings in detail, and specifically to FIGS. 1 and 3, apparatus 10 according to the present invention includes a vertical tray 12 for holding a stack of credit cards 14 therein. Tray 12 is formed by a pair of laterally spaced side plates 16 secured above a flat support plate 18 and extending vertically upward therefrom, rear guides 20 and front shuttle pressure bars 22, all of which define an enclosure for receiving the stack of credit cards 14 therein. Flat support plate 18 is inclined downwardly toward a free end **18*a* thereof, so that the credit cards 14 in the stack have an inclination, but are stacked vertically one on top of the other. In this regard, flat support plate 18 is secured to a horizontal base plate 19 by means of an angle block 21**.

Specifically, each side plate 16 is formed with upper and lower L-shaped projections 24 extending from the front edge **16*a* thereof, each L-shaped projection 24 having a horizontal leg 24*a* secured to the front edge 16*a* of a respective side plate 16 and a downwardly extending leg 24*b* which is parallel and spaced from the front edge 16*a* of the respective side plate 16. Each downwardly extending leg 24*b* is formed with a screw-threaded aperture 26 which receives a thumb screw 28. With this arrangement, side plates 16 are positioned so that two horizontal support bars 30 which are in vertically spaced relation, are positioned in the spaces between downwardly extending legs 24***b* and the front edges 16*a* of side plates 16. Then, thumb screws 28 are tightened so that side plates 16 are fixed in the positions shown in the figures. It is in this manner that side plates 16 are fixed in spaced parallel relation to define tray 12. It is noted that the lower edges 16*b* of side plates 16 are inclined with the same inclination as support plate 18 so that such lower edges 16*b* are in contact, or substantially in contact, with the upper surface of support plate 18 during their entire lengths.

The forward portion of each side plate 16 adjacent front edges 16*a*, has two shoulder pins 34 secured thereto in vertically spaced relation and which fit within a respective slot 32 formed in each shuttle pressure bar 22, so as to secure shuttle pressure bars 22 to the respective side plates 16 in vertically sliding relation. An enlarged head 33 is formed at the free end of each pin 34 to prevent the escape of shuttle pressure bars 22 therefrom, and a spacer 35 is provided on each pin 34 to space each shuttle pressure bar 22 from the respective side plate 16, as shown in FIG. 1. It is noted that both shuttle pressure bars 22 are positioned between side plates 16 so that the lower edges 22*a* thereof normally block the escape of the lowermost credit card 14 from the stack.

In this regard, a long extension rod 36 is secured to the upper end of each shuttle pressure bar 22 and extends horizontally over the upper edge of the respective side plate 16. A short extension rod 38 is secured to the upper end of each side plate 16 and extends horizontally outward therefrom. An extension spring 40 is secured between the free ends of each pair of long and short extension rods 36 and 38, as shown in FIG. 1, so as to support each shuttle pressure bar 22 on a respective side plate 16 so that shuttle pressure bars 22 normally block the escape of the lowermost credit card 14.

However, the lower rear corner 22*b* of each shuttle pressure bar 22 is rounded, as shown. Thus, when the lowermost credit card 14 in the stack is pushed toward free end 18*a* of support plate 18, it biases the shuttle pressure bars 22 upwardly, as shown in FIG. 3 against the force of extension springs 40. When the rear edge of such lowermost credit card 14 passes the lower rear corners 22*b* of shuttle pressure bars 22, extension springs 40 bias shuttle pressure bars 22 downwardly to block the new lowermost credit card 14 until a force is provided to push out the lowermost credit card 14 and overcome the force of extension springs 40.

Figure 2:
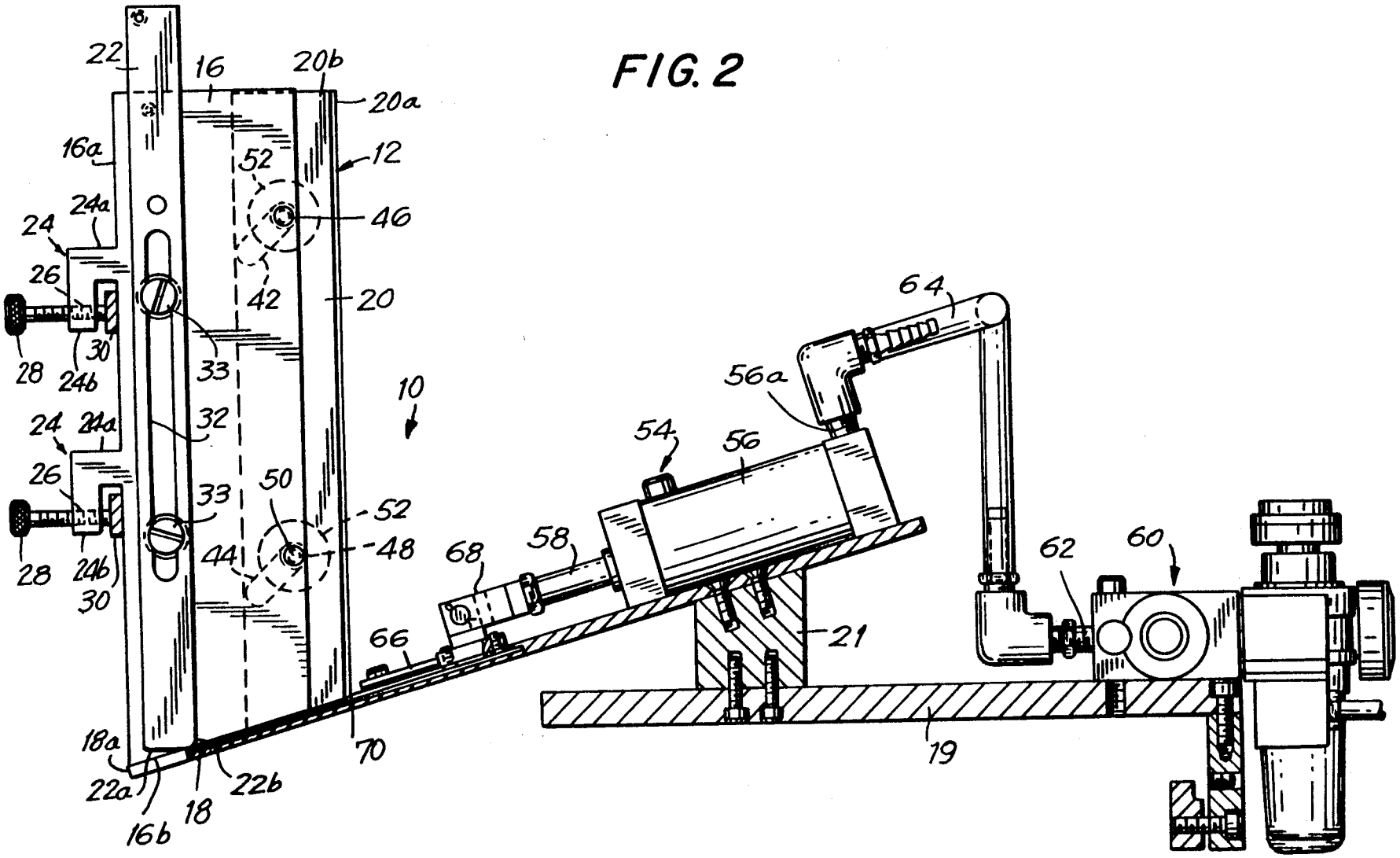
FIG. 2 is a cross-sectional view of the apparatus of FIG. 1, taken along line 2—2 thereof.

Each rear guide 20 is formed as an elongated L-shaped plate, one leg 20*a* of which forms a rear wall of the tray 12. The other leg 20*b* is secured to the respective side plate 16 by any suitable means. In the preferred embodiment, each side plate 16 is formed with upper and lower slots 42 and 44, respectively, which are inclined at the same angle as the flat support plate 18. Each leg 20*b* is formed with upper and lower apertures 46 and 48 in line with slots 42 and 44, respectively, and a tightening screw 50 is inserted through each aperture 46 and 48 and the respective slots 42 and 44 for permitting sliding movement of each rear guide 20 with respect to a respective side plate 16. Thus, each rear guide 20 can be moved to the left and right of FIG. 2 along the angle of inclination of support plate 18, and can be releasably secured at any desired position with respect to slots 42 and 44 by tightening screws 50. In order to aid in the latter, thumb nuts 52 can be positioned over the heads of screws 50 for permitting finger tightening and loosening of the same. In this manner, rear guides 20 can be moved along slots 42 and 44 to increase the size of the enclosure defined by tray 12 so as to accommodate different size credit cards 14.

In order to push the lowermost credit card 14 out from the stack, a pusher assembly 54 is provided. Specifically, pusher assembly 54 includes an air cylinder 56 secured to a rear surface area of support plate 18. Air cylinder 56 can be an Allenair cylinder Model No. P/N ACD-SR-F-110, having a slidable piston 58 extending toward the stack of credit cards 14. The air cylinder 56 preferably has a spring therein (not shown) which normally retracts piston 58 within cylinder 56, in a conventional manner. A solenoid valve 60 which controls a source of compressed air is connected to base plate 19 and has an outlet 62 connected via tubing 64 to an inlet 56*a* of air cylinder 56. Thus, when pressurized air is supplied to air cylinder 56, piston 58 is moved outwardly in the direction of the stack of credit cards 14, and when the pressurized air is removed, the spring (not shown) within air cylinder 56 retracts piston 58 in the opposite direction within air cylinder 56.

Two L-shaped guide plates 66 are secured to the upper surface of support plate 18 between air cylinder 56 and tray 12. A clevis 68 is secured to the free end of piston 58 and carries a pusher plate 70 that is guided within guide plates 66 for pushing out the lowermost credit card 14 from tray 12. Thus, when piston 58 is moved outwardly by the pressurized air, it causes pusher plate 70 to move under rear guides 20 and engage the rear edge of the lowermost credit card 14. Upon continued movement of piston 58, and thereby pusher plate 70, the lowermost credit card 14 abuts the lower rear corners 22*b* of shuttle pressure bars 22 and moves the latter upwardly against the force of extension springs 40. As such, the leading or forward edge of the lowermost credit card 14 escapes from tray 12 and extends outwardly therefrom, as shown best in FIG. 3.

Figure 4:
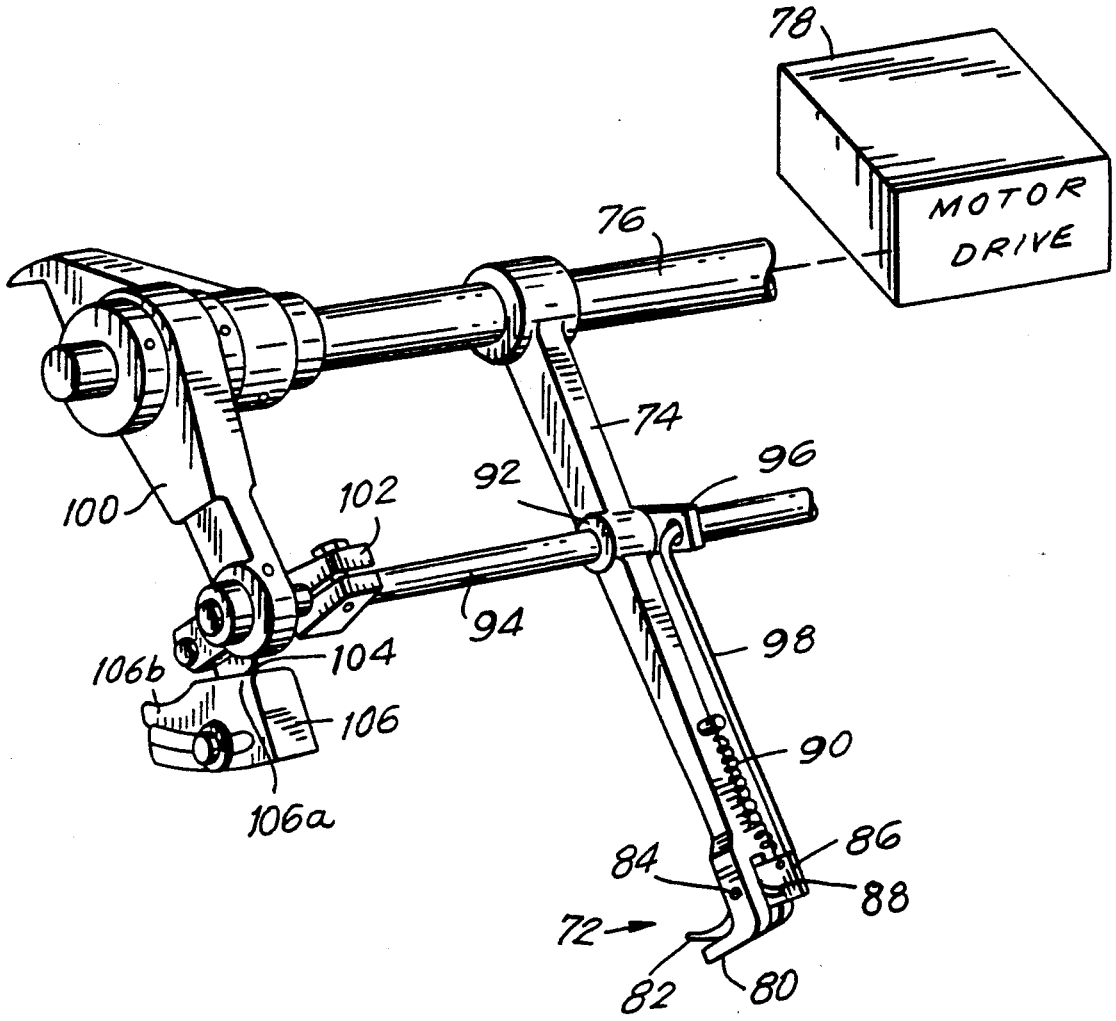
FIG. 4 is an enlarged perspective view of the gripper mechanism and the control means for controlling operation of the gripper mechanism.
Figure 5:
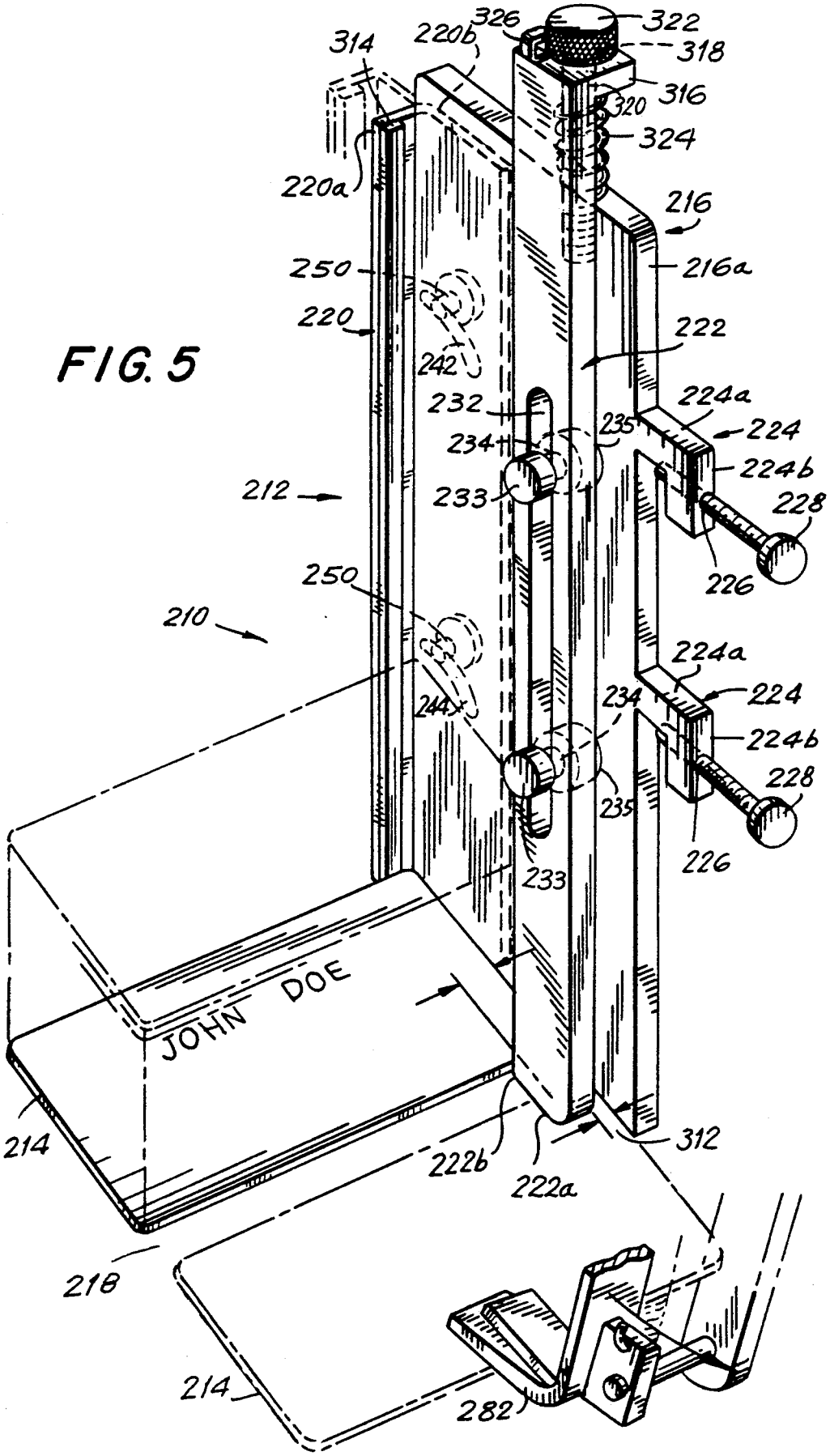
FIG. 5 is a perspective view of apparatus for positioning a credit card according to another embodiment of the present invention.

Referring now to FIGS. 3 and 4, apparatus 10 further includes a gripper mechanism 72 for grasping the outwardly extending forward edge of the lowermost credit card 14 that has been pushed partially out of the tray 12 by pusher plate 70. Gripper mechanism 72 includes an elongated connecting arm 74 fixed to an oscillating shaft 76 which is rotated by a motor means 78 in a reciprocal manner. A fixed gripper jaw 80 is integrally formed at the free end of connecting arm 74 and extends substantially perpendicular thereto toward tray 12. A pivotable gripper jaw 82 is pivotally connected at the lower end of connecting arm 74 by a pivot pin 84 so that the lower surface of gripper jaw 82 and the upper surface of gripper jaw 80 form gripping surfaces which are adapted to grip a credit card 14 therebetween, as shown in FIG. 3.

A plate 86 is fixed to the rear portion of gripper jaw 82 and extends rearwardly of connecting arm 74. Pivot pin 84 extends through an arcuate slot 88 in arm 74, and in this manner, pivotally connects gripper jaw 82 to connecting arm 74. Normally, gripper jaw 82 is pivoted to its closed position so as to grasp a credit card 14 with gripper jaw 80, as shown in FIG. 3. Specifically, a spring 90 is connected between the rearward, upper end of plate 86 and a higher point on connecting arm 74, so as to normally pivot gripper jaw 82 to its closed, gripping position.

In order to open gripper jaw 82, connecting arm 74 is formed with a bore 92 extending transversely therethrough and a shaft 94 is rotatably journalled therein. A flange 96 is connected to shaft 94 adjacent bore 92 and extends radially outward therefrom. A pivot rod 98 is connected between flange 96 and plate 86, whereby rotation of shaft 94 in the clockwise direction of FIGS. 3 and 4 causes a downward movement of pivot rod 98. This, in turn, causes rotation of gripper jaw 82 about pivot pin 84 against the force of spring 90, thus opening gripper jaw 82. The slot 88 in arm 74 results in free pivotal movement of gripper jaw 82 due to the opening force exerted by pivot rod 98, that is, slot 88 moves along pivot pin 84 at such time to prevent sticking of the gripper jaw 82, while still permitting pivotal movement of gripper jaw 82.

In order to control rotation of shaft 94, one end of shaft 94 is rotatably connected to a shaft support 100, the opposite end of shaft support 100 being fixedly connected to rotatable shaft 76. A clamp 102 is fixedly connected to shaft 94 at a position between connecting arm 74 and shaft support 100, and has a cam follower roller 104 secured thereon. Cam follower roller 104 rides on a cam track 106. Thus, when cam follower roller 104 rides along a higher portion 106*a* of cam track 106, as shown in FIG. 4, shaft 94 is rotated clockwise so as to force pivot rod 98 downwardly, thereby resulting in opening of gripper jaw 82 against the force of spring 90. When cam follower roller 104 rides along a lower portion 106*b* of cam track 106, there is no longer a downward force on pivot rod 98. As a result, spring 90 pivots gripper jaw 82 to its closed gripping position. At such time, the force of spring 90 on pivoting gripper jaw 82 causes pivot rod 98 to move upwardly and thereby rotate shaft 94 counter-clockwise. As a result, cam follower roller 104 remains in contact with cam track 106. The above arrangement of gripper mechanism 72 is conventional and is sold by Bell and Howell under Model No. 7200.

In operation, pusher plate 70 pushes out the lowermost credit card 14 from tray 12, as shown in FIG. 3. At such time, shuttle pressure bars 22 are moved upwardly to permit egress of such lowermost credit card 14. Then, shaft 76 is rotated so that gripper mechanism 72 is moved toward such lowermost credit card 14. At such time, cam track 106 results in gripper jaw 82 being in its opened position. When gripper jaws 80 and 82 are positioned on opposite sides of the lowermost credit card 14, continued rotation of shaft 76 causes cam follower roller 104 to ride on a lower section of cam track 106, causing spring 90 to pivot gripper jaw 82 to its closed gripping position, as shown in FIG. 3. As a result, the lowermost credit card 14 is gripped between gripper jaws 80 and 82.

Then, shaft 76 is rotated in the opposite direction which is clockwise in FIG. 3. During such movement, cam follower roller 104 rides on upper portion 106*a* of cam track 106, which moves gripper jaw 82 to its opened position so as to release the gripped credit card 14. During this swinging movement of gripper mechanism 72, and the release of the credit card 14, the credit card 14 falls accurately on two dabs 108 of adhesive on a piece of paper 110 positioned by another assembly (not shown) beneath the gripper mechanism 72. Thereafter, the process is continued, whereby the gripper mechanism 72 is returned to grip another credit card 14. Thus, there is accurate grasping and positioning of each credit card, even if the latter is bent during the handling process.

It will be appreciated that, in normal operation, a plurality of pieces of paper or inserts 110 are positioned under each credit card 14, with the credit card being adhered only to the topmost piece of paper 110. In such case, inserts 110 are pulled from vertical trays which hold stacks of such inserts 110. The inserts 110 are pulled from the stacks by gripper mechanisms which are substantially identical to gripper mechanism 72 used to grip and position credit card 14. However, the gripper mechanisms for the inserts 110 move with a different timing from gripper mechanism 72, and are therefore adjusted accordingly.

Referring now to FIGS. 5–8, apparatus 210 according to another embodiment of the present invention will now be described, in which elements similar to those identified in the embodiment of FIGS. 1–4 will be referenced by the same numerals augmented by 200, and a detailed description thereof will be omitted for the sake of brevity.

It will first be noted that, as with the embodiment of FIGS. 1–4, each shuttle pressure bar 222 is spaced from its respective side plate 216 by a gap 312, by means of spacers 235. As a result, the lower edge 222*a* of each front shuttle plate 222 is spaced away from the respective short edge of the lowermost credit card 214 so as to avoid any problems in withdrawing such credit card 214 from the stack. In this regard, it is noted that the short edges of the cards 214 in the stack are positioned against side plate 216.

In addition, each leg 220*a* of rear guide 220 has a wear strip 314 made of "Teflon" or the like extending in the vertical direction along the length thereof, to aid in the sliding movement of cards 214 in the stack as the stack is reduced in height, that is, when cards 214 are removed from the stack.

Further, extension rods 36 and 38 and springs 40 are eliminated in this embodiment. Rather, the upper end of each shuttle pressure bar 222 is formed with an extension plate 316 extending outwardly at a substantially right angle therefrom, each extension plate 316 having an aperture 318 therethrough. A screw 320 having an enlarged head 322 slidably extends through aperture 318 and is screw threadedly received in the plate 216. A coil spring 324 surrounds screw 320 and extends between the lower surface of extension plate 316 and the upper surface of side plate 216 to normally space extension plate 316 of shuttle pressure bar 222 from the upper edge 216*a* of side plate 216, and to bias the upper surface of extension plate 316 into engagement with the undersurface of enlarged head 322.

Thus, each shuttle pressure bar 222 rests in a stable manner on a spring 324. By adjusting screws 320, the upward travel of each shuttle pressure bar 222 can be limited to permit only one credit card 214 to pass under shuttle pressure bars 222, depending upon the height of each such card 214. In such case, spring 324 will always bias extension plate 316 into engagement with enlarged head 322. In addition, in order to prevent accidental turning or loosening of each screw 320, a spring steel detent 326 is secured to the upper surface of each extension plate 316, and normally engages the knurled surface of the respective enlarged head 322 thereat to prevent turning thereof. However, such detent 326 can be easily biased away by a finger from enlarged head 322 to permit adjustment of screw 320.

Figures 6, 7:
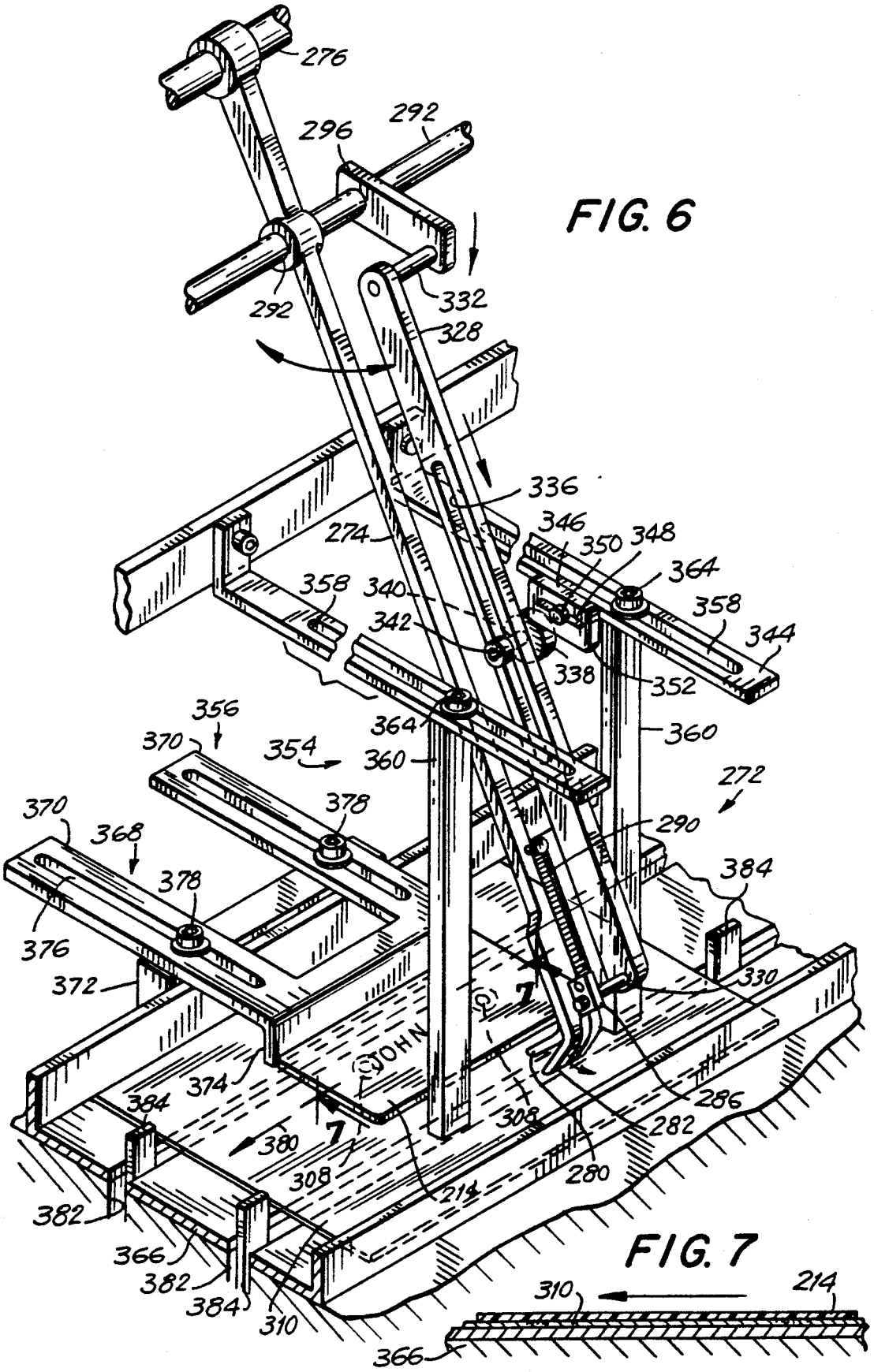
FIG. 6 is a perspective view of apparatus for positioning a credit card according to still another embodiment of the present invention.
FIG. 7 is a cross-sectional view of the apparatus of FIG. 6, taken along line 7—7 thereof.

FIG. 6 shows the gripper mechanism 272 at the position where the latter has dropped the gripped credit card 214 onto a piece of paper 310. In this embodiment, an elongated link arm 328 is connected at its lower end by a pivot rod 330 to plate 286. The upper end of link arm 328 is connected by a pivot rod 332 to a flange 296 which is secured to and rotates (oscillates) with shaft 294. Thus, link arm 328 performs the same function as pivot rod 98 in the embodiment of FIGS. 1-4. Specifically, as shaft 294 is rotated, link arm 328 moves accordingly to cause gripper jaws 280 and 282 to open to release a gripped credit card or to close to grip a credit card.

The timing for effecting gripping by gripper jaws 280 and 282 can be easily adjusted with the embodiment of FIG. 6. Specifically, link arm 328 includes an elongated slot 336 therein, and a cam follower roller 338 is adjustably fixed within slot 336. In this regard, cam follower roller 338 includes a shaft 340 that extends through slot 336 and has an enlarged nut 342 screw-threadedly received on the free end of shaft 340. Thus, when nut 342 is tightened, cam follower roller 338 is set at a fixed position within slot 336. When nut 342 is loosened, cam follower roller 338 can be adjusted with respect to slot 336.

A fixed horizontal support 344 extends adjacent to cam follower roller 338, and a cam 346 is adjustably secured on support 344. Specifically, cam 346 includes an elongated horizontal slot 348 through which a bolt 350 extends so as to be screw-threadedly received in horizontal support 344. When bolt 350 is loosened, cam 346 can be moved horizontally along the length of support 344, and can be tightened to fix cam 346 at any position therealong. The lower surface of cam 346 forms a cam surface 352 against which cam follower roller 338 rides. Thus, by adjusting the positions of cam 346 along support 344 and cam follower roller 338 along slot 336, gripper jaws 280 and 282 can be controlled to vary the time of release or gripping of the credit cards 214.

Figure 8:
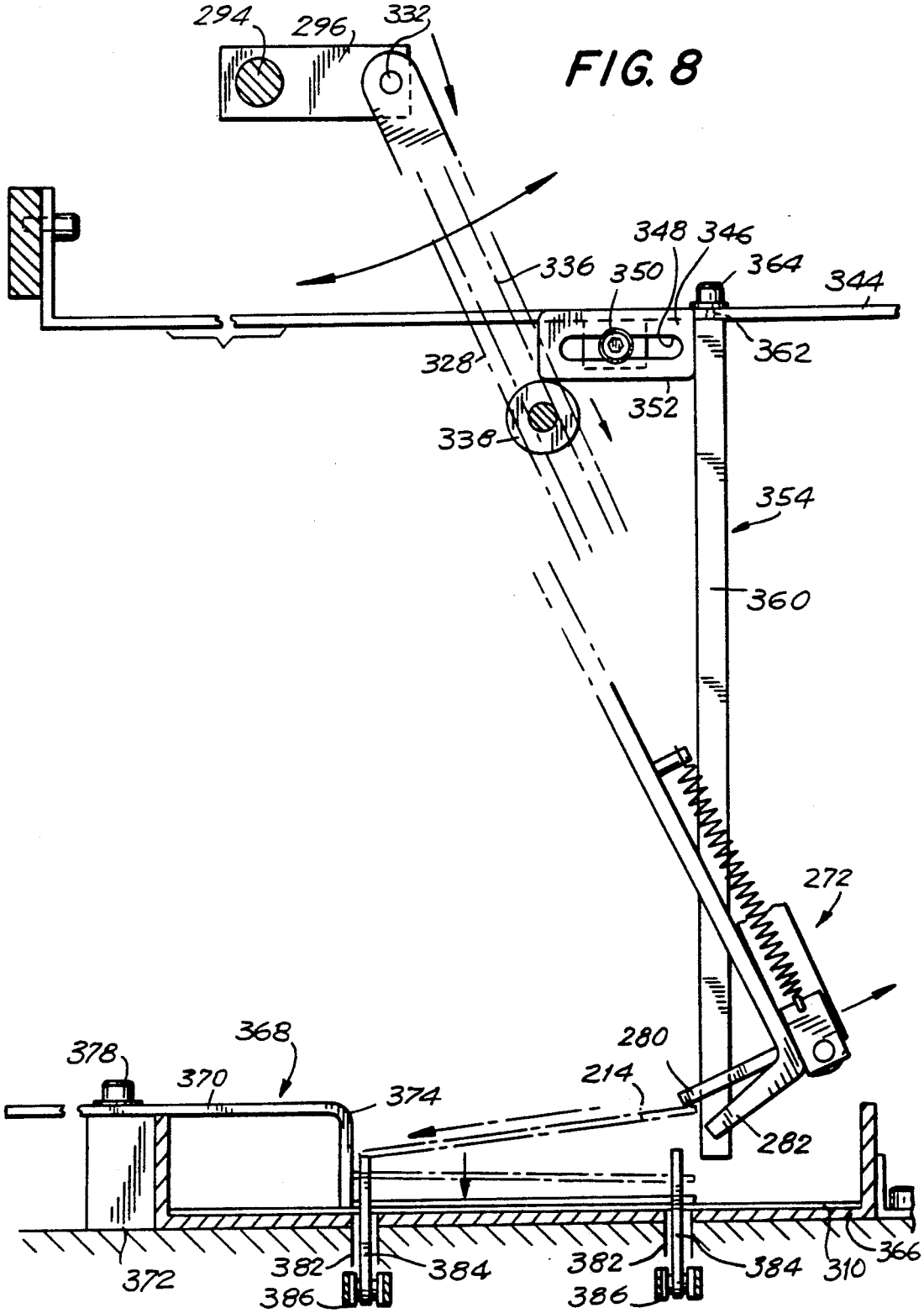
FIG. 8 is a side elevational view of the apparatus of FIG. 6.

Even with the present gripper arrangement, when a credit card 214 is released, it is still sometimes carried past the desired drop area by a small distance. In order to ensure that each card 214 is dropped precisely at the correct area on paper 310, adjustable front and rear guides 354 and 356, respectively, are provided. As shown, two horizontal supports 344 are provided at the same height in parallel relation to each other, each horizontal support 344 including an elongated slot 358 extending therealong. Front guide 354 includes two vertically extending posts 360, each supported by a respective horizontal support 344. More particularly, a pin 362 extends from the upper end of each post 360 through the respective slot 358, and a nut 364 is screw-threadedly received on each pin 362 to adjustably secure the posts 360 at any desired position along horizontal supports 344. The lower ends of posts 360 extend close to the upper surface of a stationary conveyor table 366. Thus, as shown in FIG. 8, when gripper jaws 280 and 282 release the credit card 214 during travel of the gripper jaws 280, such released credit card 214 will hit against posts 360 and fall directly down onto the desired area, and specifically, onto the dabs 308 of adhesive.

Rear guide 356 limits movement of the opposite edge of the dropped credit card 214. In this regard, rear guide 356 includes an L-shaped plate 368 having a two horizontal legs 370 that are adjustably secured to a support 372 at a position parallel to and spaced slightly above conveyor table 366, and a downwardly extending leg 374 that provides a stop limit for the opposite edge of the dropped credit card 214. Each leg 370 includes an elongated slot 376 therein through which a bolt 378 extends for securement within respective screw-threaded apertures (not shown) in support 372, whereby rear guide 356 can be adjustably moved in the left or right direction of FIG. 8, depending upon the width of the credit card 214. Thus, by use of front and rear guides 354 and 356, the dropped credit card 214 accurately falls on the desired area of paper 310.

Once the card 214 is dropped onto the dabs 308 of adhesive on paper 310, paper 310 with card 214 adhered thereon is moved to the next station in the direction of arrow 380. In this regard, stationary conveyor table 366 is formed with two guide slots 382. Pairs of pusher fingers 384 extend through guide slots 382, each pair being spaced along the length of guide slots 382, and each pusher finger 384 in the proximity shown in FIGS. 6 and 8 extending above the upper surface of stationary conveyor table 366. The lower ends of pusher fingers 384 are connected to respective endless chains 388, shown in FIG. 8, which carry the pusher fingers 384 around a loop. Thus, each pair of pusher fingers 384 hits the end of a piece of paper 310 on conveyor table 366 at the position shown, and moves the same away from gripper jaws 280 and 282 in the direction of arrow 380, and at the same time, moves a fresh piece of paper 310 to the position shown in FIG. 6 to receive a new card 214.

Although the present invention has been described with respect to the gripping of a credit card, it will be appreciated that the present invention can be used with any relatively rigid card, paper or the like.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. Apparatus for accurately dispensing and positioning a flat member onto a predetermined area of a surface, comprising:

support means for supporting a stack of flat members, each flat member having a leading edge, said support means including a support plate on which said stack of flat members is supported and at least one shuttle pressure bar slidably mounted for substantially vertical movement above said support plate and in front of said stack of flat members so as to limit escape only of the lowermost one of said flat members from said stack, under said at least one shuttle pressure bar;

pusher means for pushing out the leading edge of the lowermost one of said flat members in said stack under said at least one shuttle pressure bar;

gripper means for gripping said leading edge of said pushed out flat member; and control means for controlling said gripper means to grip said leading edge of said pushed out flat member, to move over said predetermined area of said surface and to then release said gripped flat member so that the latter drops onto said predetermined area of said surface.

2. Apparatus according to claim 1; wherein said support means further includes tray means positioned above said support plate for holding said stack of flat members in a predetermined position on said support plate.

3. Apparatus according to claim 2; wherein said flat members have opposite side edges, a rear edge and said leading edge, and said tray means includes first and second side plate means spaced from each other and positioned above said support plate for guiding said opposite side edges of said flat members in said stack.

4. Apparatus according to claim 3; wherein said tray means further includes rear guide means for guiding said rear edges of said flat members.

5. Apparatus according to claim 4; wherein said rear guide means includes a first rear guide secured to said first side plate means and a second rear guide secured to said second side plate means.

6. Apparatus according to claim 5; wherein said rear guide means includes wear strip means secured to each of said first and second rear guides for enabling free sliding movement of said flat members in said stack therealong.

7. Apparatus according to claim 3; wherein said first and second side plate means include securing means for securing said first and second side plate means in opposing spaced relation above said support plate.

8. Apparatus according to claim 1; wherein said pusher means includes:

pusher plate means for pushing out said leading edge of said lowermost one of said flat members from said stack;

piston means connected to said pusher plate means for controlling movement of said pusher plate means so that the latter pushes out said leading edge;

cylinder means for moving said piston means between an extended position and a retracted position; and cylinder control means for controlling said cylinder means to move said piston means between said extended and retracted positions.

9. Apparatus according to claim 1; wherein said gripper means includes a connecting rod rotatable between a release position and a gripping position, a fixed gripper jaw connected to a free end of said connecting rod, and a pivotable gripper jaw pivotally connected to said free end of said connecting rod for cooperation with said fixed gripper jaw to releasably grip the leading edge of the lowermost one of said flat members; and said control means includes actuating means for actuating said pivotable gripper jaw to selectively grip and release said leading edge in cooperation with said fixed gripper jaw.

10. Apparatus according to claim 9; wherein said actuating means includes spring means for normally biasing said pivotable gripper jaw to one of a closed gripping and open non-gripping position for gripping a flat member between said gripping jaws, and release means connected with said pivotable gripping jaw for biasing said pivotable gripper jaw to the other of said closed gripping position and open non-gripping position with respect to said fixed gripper jaw.

11. Apparatus according to claim 10; wherein said connecting rod includes a transverse bore, and said release means includes:

a shaft rotatably journalled in said transverse bore and movable with said connecting rod;

pivot rod means connected between said shaft and said pivotable gripper jaw for causing pivoting movement of said pivotable gripper jaw with respect to said fixed gripper jaw upon selected rotation of said shaft;

a cam track; and a cam means secured on said shaft and in engagement with said cam track for selectively controlling rotation of said shaft.

12. Apparatus according to claim 10; wherein said connecting rod includes a transverse bore, and said release means includes:

a shaft rotatably journalled in said transverse bore and movable with said connecting rod;

pivot rod means connected between said shaft and said pivotable gripper jaw for causing pivoting movement of said pivotable gripper jaw with respect to said fixed gripper jaw upon selected rotation of said shaft; and adjustment means for controlling said pivot rod means to cause said pivotable gripper jaw to move away from said fixed gripper jaw so as to release the gripped flat member.

13. Apparatus according to claim 12; wherein said adjustment means includes:

a cam surface; and cam means secured on said pivot rod means and in engagement with said cam surface for selectively controlling rotation of said shaft.

14. Apparatus according to claim 13; wherein said pivot rod means includes an elongated slot therein, and said cam means includes a cam follower roller adjustably secured with respect to said elongated slot.

15. Apparatus according to claim 13; wherein release means includes adjustment means for adjustably securing said cam surface at any of a plurality of positions with respect to said cam means.

16. Apparatus according to claim 1; further including position adjusting means for ensuring that said released flat member drops accurately onto said predetermined area of said surface.

17. Apparatus according to claim 16; wherein said position adjusting means includes front guide means for preventing travel of a front edge of said released flat member past a predetermined position.

18. Apparatus according to claim 16; wherein said position adjusting means includes rear guide means for preventing travel of a rear edge of said released flat member past a predetermined position.

19. Apparatus for accurately dispensing and positioning a flat member onto a predetermined area of a surface, said flat members having opposite side edges, a rear edge and a leading edge, said apparatus comprising:

support means for supporting a stack of flat members, said support means including a support plate on which said stack of flat members is supported and tray means positioned above said support plate for holding said stack of flat members in a predetermined position on said support plate, said tray means including first and second side plate means spaced from each other and positioned above said support plate for guiding said opposite side edges of said flat members in said stack, and front guide means positioned above said support plate for guiding said leading edges of said flat members, said front guide means including at least one shuttle pressure bar secured to at least one of said first and second side plate means and vertically movable therealong;

pusher means for pushing out a leading edge of a lowermost one of said flat members in said stack;

gripper means for gripping said leading edge of said pushed out flat member; and control means for controlling said gripper means to grip said leading edge of said pushed out flat member, to move over said predetermined area of said surface and to then release said gripped flat member so that the latter drops onto said predetermined area of said surface.

20. Apparatus according to claim 19; wherein each of said first and second side plate means includes a pin, and said front guide means includes first and second shuttle pressure bars, each having a vertical elongated slot for slidably mounting the pins of said first and second side plate means therein so as to slidably mount said first and second shuttle pressure bars to said first and second side plate means, respectively.

21. Apparatus according to claim 20; wherein said tray means further includes biasing means for biasing said first and second shuttle pressure bars toward said support plate when a leading edge of a lowermost one of said flat members is pushed out from said stack.

22. Apparatus according to claim 21; wherein said biasing means includes first extension spring means connected between an upper end of said first side plate means and an upper end of said first shuttle pressure bar for normally biasing said first shuttle pressure bar toward said support plate, and second extension spring means connected between an upper end of said second side plate means and an upper end of said second shuttle pressure bar for normally biasing said second shuttle pressure bar toward said support plate.

23. Apparatus according to claim 19; further including spacer means for spacing each said shuttle pressure bar from a respective one of said first and second side plate means.

24. Apparatus according to claim 19; further including spring means for resiliently supporting each shuttle pressure bar on a respective side plate, and stop means for limiting upward travel of each said shuttle pressure bar with respect to the respective side plate.

25. Apparatus according to claim 24; wherein said stop means includes screw means screw threadedly received in an upper end of each side plate for extending through an aperture in the respective shuttle pressure bar, and said spring means includes a coil spring surrounding each screw means and positioned between said shuttle pressure bar and an upper end of the respective side plate.

26. Apparatus for accurately dispensing and positioning a flat member onto a predetermined area of a surface, said flat members having opposite side edges, a rear edge and a leading edge, said apparatus comprising:

support means for supporting a stack of flat members, said support means including a support plate on which said stack of flat members is supported and tray means positioned above said support plate for holding said stack of flat members in a predetermined position on said support plate, said tray means including first and second side plate means spaced from each other and positioned above said support plate for guiding said opposite side edges of said flat members in said stack, front guide means positioned above said support plate for guiding said leading edges of said flat members, and rear guide means for guiding said rear edges of said flat members, said rear guide means including a first rear guide secured to said first side plate means and a second rear guide secured to said second side plate means, each said first and second side plate means including at least one slot, and said first and second rear guides are slidably connected in said at least one slot of said first and second side plate means, respectively, and include securing means for releasably securing said first and second rear guides in selected positions in said at least one slot to adjust said tray means for different size flat members;

pusher means for pushing out a leading edge of a lowermost one of said flat members in said stack;

gripper means for gripping said leading edge of said pushed out flat member; and control means for controlling said gripper means to grip said leading edge of said pushed out flat member, to move over said predetermined area of said surface and to then release said gripped flat member so that the latter drops onto said predetermined area of said surface.

* * * * *